US006773184B2

(12) United States Patent
An

(10) Patent No.: US 6,773,184 B2
(45) Date of Patent: Aug. 10, 2004

(54) INTEGRATED LIPSTICK AND LIP PENCIL

(76) Inventor: Suck-Doo An, 158-63 Annyoung-Ri, Taean-Eup, Hwasung-Gun, 445-976 Kyounggi-Do (KR)

( * ) Notice: Subject to any disclaimer, the term of this patent is extended or adjusted under 35 U.S.C. 154(b) by 0 days.

(21) Appl. No.: 10/240,493

(22) PCT Filed: Nov. 21, 2001

(86) PCT No.: PCT/KR01/01999

§ 371 (c)(1),
(2), (4) Date: Oct. 2, 2002

(87) PCT Pub. No.: WO02/062172

PCT Pub. Date: Aug. 15, 2002

(65) Prior Publication Data

US 2003/0138281 A1 Jul. 24, 2003

(30) Foreign Application Priority Data

Feb. 3, 2001 (KR) ..... 2001-5281

(51) Int. Cl.[7] ..... B43K 27/00

(52) U.S. Cl. ..... 401/31; 401/17; 401/19; 401/20; 401/32; 401/34; 401/68; 401/75

(58) Field of Search ..... 401/17, 19, 20, 401/29, 31, 32, 34, 64, 68, 69, 71, 75–78, 88

(56) References Cited

U.S. PATENT DOCUMENTS

| | | | | | |
|---|---|---|---|---|---|
| 5,306,107 | A | * | 4/1994 | Kageyama et al. | 401/31 |
| 6,155,734 | A | * | 12/2000 | Kageyama et al. | 401/32 |
| 6,345,922 | B2 | * | 2/2002 | Tani | 401/32 |
| 6,368,001 | B1 | * | 4/2002 | Roeder | 401/31 |
| 6,371,673 | B1 | * | 4/2002 | Gueret | 401/31 |

FOREIGN PATENT DOCUMENTS

DE 8904540 U1 7/1989

* cited by examiner

*Primary Examiner*—Tuan N. Nguyen
(74) *Attorney, Agent, or Firm*—Thomas R. FitzGerald, Esq.

(57) ABSTRACT

An integrated lipstick and lip pencil comprises a lipstick part for painting a user's lips with a lipstick of a prescribed color, a lip pencil part for penciling a lip line using a lip pencil, and a coupling part for coupling the lipstick part and the lip pencil part to combine them into one body.

13 Claims, 13 Drawing Sheets

INTEGRATED LIPSTICK AND LIP PENCIL

This application claims the benefit of the filing date of Korean Patent Application Number P2001-5281, filed 3 Feb. 2001 and PCT/KR01/01999, filed 21 Nov. 2001.

TECHNICAL FIELD

The present invention relates to an integrated lipstick and lip pencil (or lip liner), and more particularly, to an integrated lipstick and lip pencil, in which a lipstick for painting a prescribed color on a user's lips and a lip pencil for penciling a clear lip line are combined integrally.

BACKGROUND ART

In general, a lipstick is one of cosmetics for painting a user's lips. The lipstick includes a lipstick core being in the form of a solid bar, a hollow body for protecting the lipstick core and a cover for covering the body. Here, the body includes a screw part having an inside spiral part, a fixed part coupled in a rotatably manner relative to the screw part and a lipstick core supporter.

In such lipstick, when the screw part is rotated relative to the fixed part, the lipstick core supporter is also moved together with the screw part. Thereby, the lipstick core and the core supporter are exposed to the outside or enter the inside of the body along a spiral line of the screw part. Therefore, the user can paint the lips with the lipstick core exposed to the outside. After the use of the lipstick, the user lets the lipstick core in the body to protect the lipstick core, and then covers the cover.

A lip pencil is one of cosmetics for penciling a clear lip line and used for lip makeup with the lipstick. The lip pencil has a structure similar with the structure of the lipstick. When a prescribed part of a body is rotated after a cover is separated from the body, a pencil core is exposed to the outside or enters inside of the body. Therefore, the user can pencil the lip line with the pencil core exposed to the outside. After the use of the lip pencil, the user lets the pencil core in the body to protect the pencil core and covers the cover.

However, to paint the user's lips, because the user must buy and use the lipstick for painting color on the lips and the lip pencil for penciling the lip line separately, costs for buying the cosmetics are increased twice and it is inconvenient in use and carrying.

Furthermore, in the prior arts, the lipstick and lip pencil are easily separated from each other even by a small shock because being simply combined, and thereby the user cannot use until the contents of the cosmetics are completely consumed.

DISCLOSURE OF INVENTION

Therefore, it is an object of the present invention to provide an integrated lipstick and lip pencil capable of having both functions of a lipstick and a lip pencil by integrally combining the lipstick and the lip pencil.

It is another object of the present invention to provide an integrated lipstick and lip pencil, which is combined by a spline, a coupling hole and a coupling jaw, so that components constituting the lipstick and the lip pencil can be separated from each other when shock above a prescribed power is applied by a user to perform their own function.

To achieve the above objects, the present invention provides an integrated lipstick and lip pencil including a lipstick part for painting color on the user's lips, a lip pencil part for penciling a lip line and a coupling part for connecting the lipstick part and the lip pencil part to form a body.

The present invention can be changed, converted, replaced and substituted within a range of the business model, technical method and system and is not restricted in the above.

BRIEF DESCRIPTION OF THE DRAWINGS

Further objects and advantages of the invention can be more fully understood from the following detailed description taken in conjunction with the accompanying drawing in which.

BEST MODE FOR CARRYING OUT THE INVENTION

Figure 1:
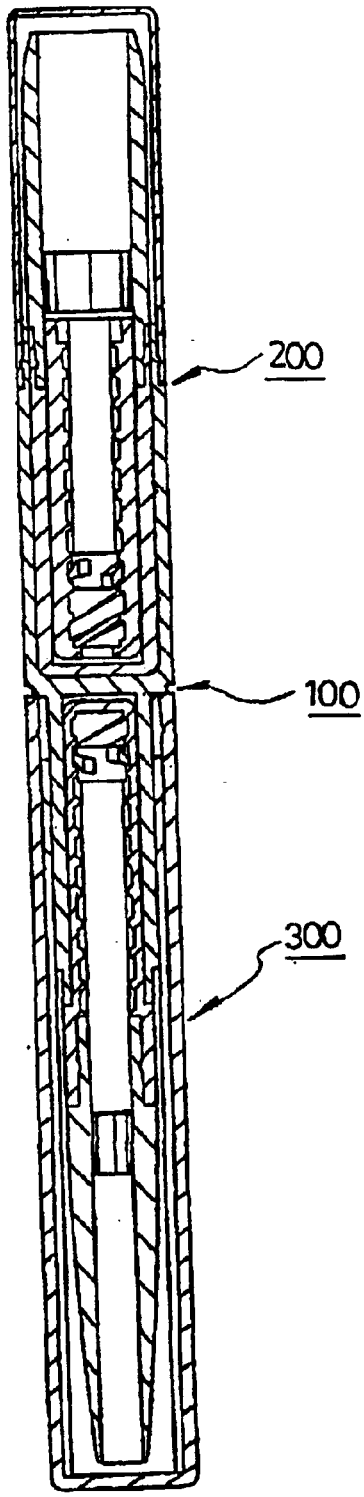
FIG. 1 illustrates a view of a structure of an integrated lipstick and lip pencil according to the present invention.

The present invention will now be described in detail in connection with preferred embodiments with reference to the accompanying drawings. For reference, like reference characters designate corresponding parts throughout several views.

FIG. 1 illustrates a view of a structure of an integrated lipstick and lip pencil according to the present invention. In FIG. 1, the integrated lipstick and lip pencil includes a lipstick part 200 for painting color on a user's lips, a lip pencil part 300 for penciling a lip line and a coupling part 100 for connecting the lipstick part 200 and the lip pencil part 300 to form a body.

The above components will be described in more detail as follows.

Figure 2:
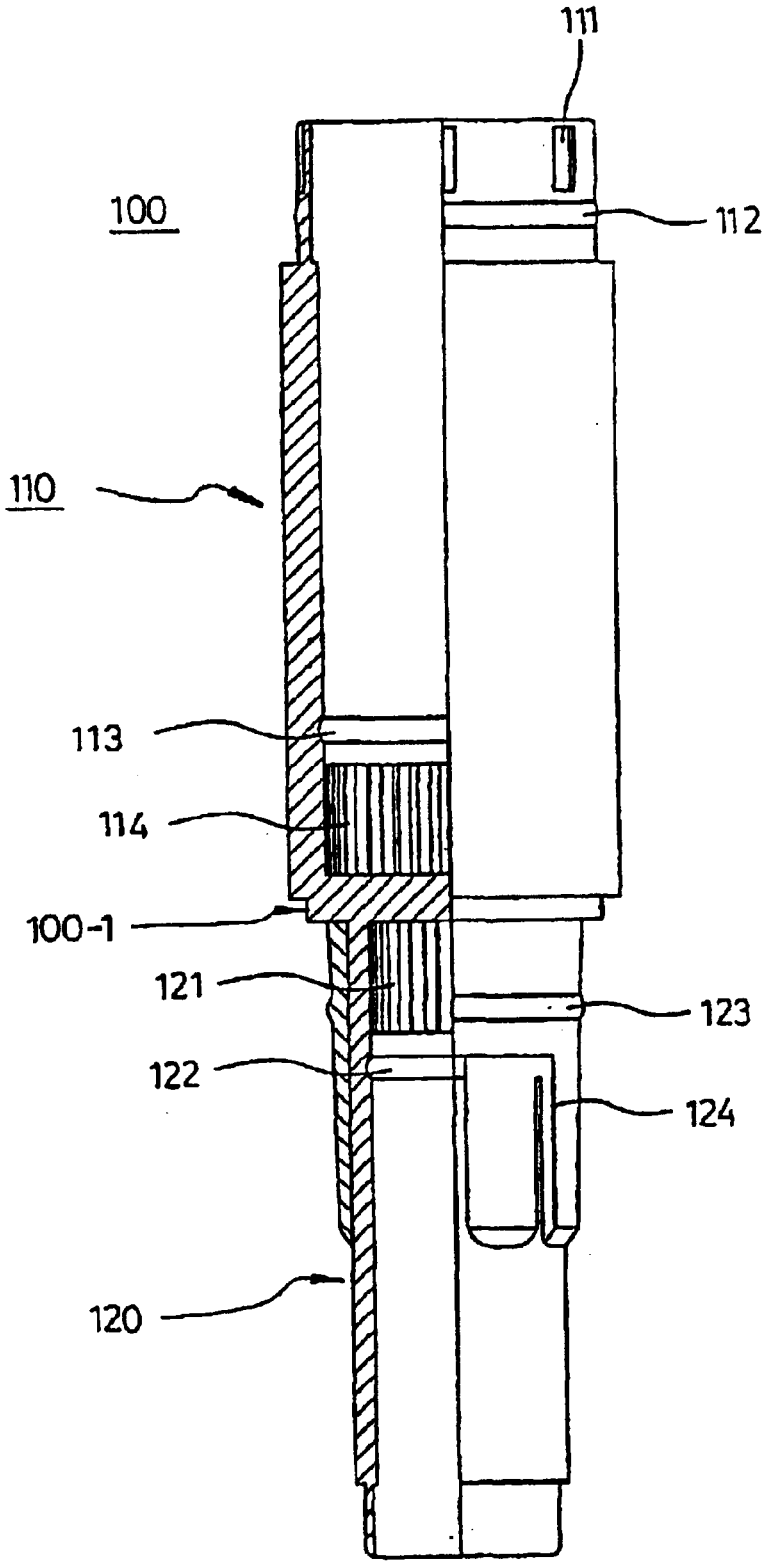
FIG. 2 illustrates a partial sectional view of a coupling part of the integrated lipstick and lip pencil according to the present invention.

FIG. 2 illustrates a partial sectional view of the coupling part 300 of the integrated lipstick and lip pencil according to the present invention.

As shown in FIG. 2, the coupling part 100 includes a lipstick coupling part 110 to be coupled with the lipstick part 200 at a side and a lip pencil coupling part 120 to be coupled with the lip pencil part 300 at the other side. Here, the lipstick part 200 and the lip pencil part 300 respectively have an empty inside centering a central part 100-1 of the coupling part 100.

The lipstick coupling part 110 includes a lipstick coupling inner spline 114 and a lipstick coupling inner hole 113 formed inside the central part 100-1 for coupling with the lipstick part 200, and a lipstick coupling outer spline 111 and a lipstick coupling outer jaw 112 formed outside of an end portion of the central part 100-1.

Moreover, the lip pencil coupling part 120 includes a lip pencil coupling inner spline 121 and a lip pencil coupling inner hole 122 formed inside the central part 100-1 for coupling with the lip pencil part, and a lip pencil coupling outer spline 124 and a lip pencil coupling outer jaw 123 formed outside of the central part 100-1 for coupling with the lip pencil part 300.

Figure 3:
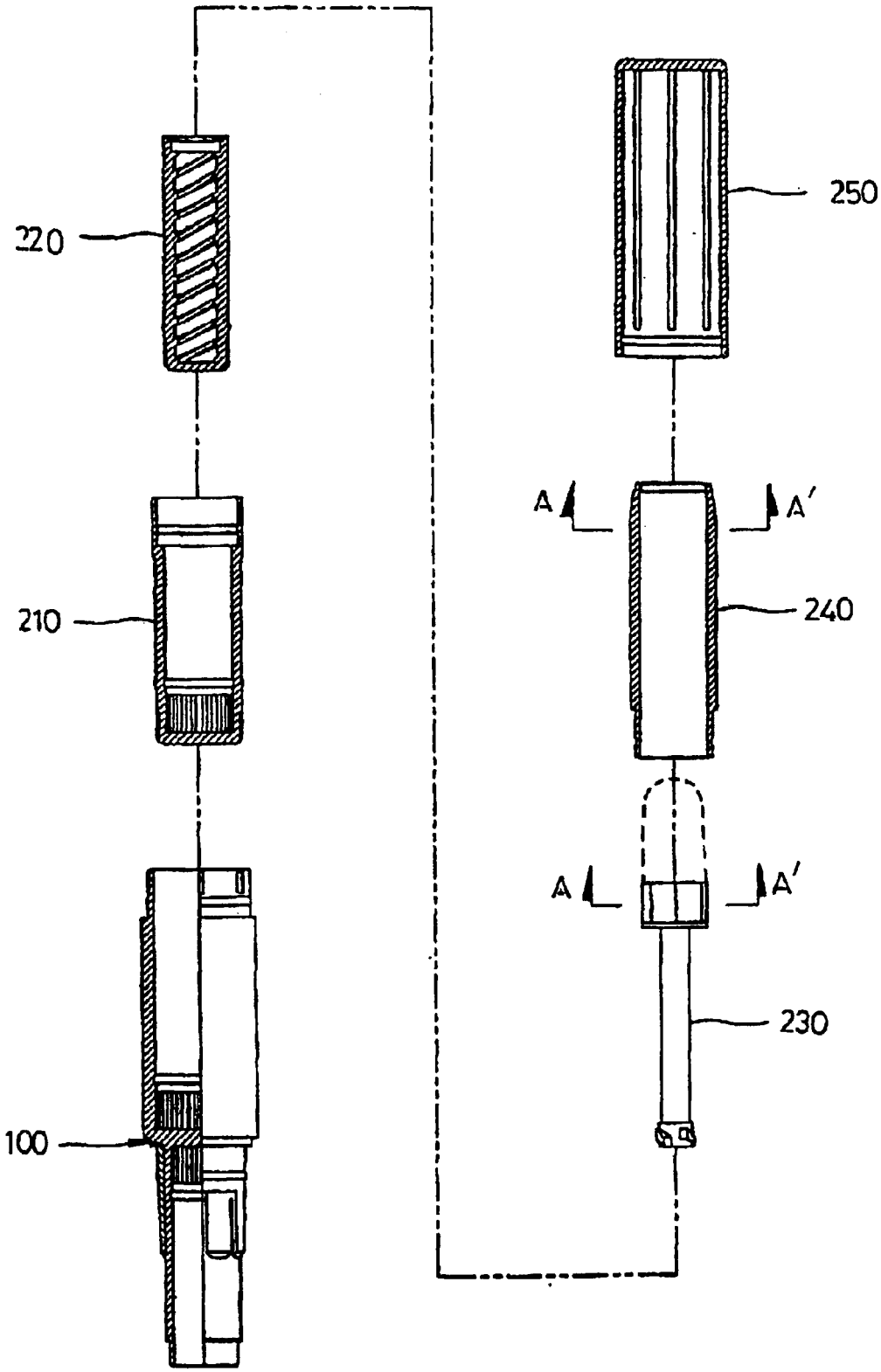
FIG. 3 illustrates a view of an assembly of a lipstick part of the integrated lipstick and lip pencil according to the present invention.

FIG. 3 illustrates a view of an assembly of a lipstick part of the integrated lipstick and lip pencil according to the present invention. In FIG. 3, the lipstick part 200 includes a central body 210 inserted into the lipstick coupling part 110 of the coupling part 100, a lipstick screw part 220 inserted into the central body 210, a lipstick core supporter 230 inserted into the lipstick screw part 220 and moving along a spiral line of the lipstick screw part 220, a lipstick cap 240 guiding a movement of the lipstick core supporter 230 when the lipstick core supporter 230 is moved and protecting the lipstick core (not shown), and a lipstick outer cap 250 for covering the lipstick cap 240. Here, the central body 210 serves as a joint pipe.

Figure 4:
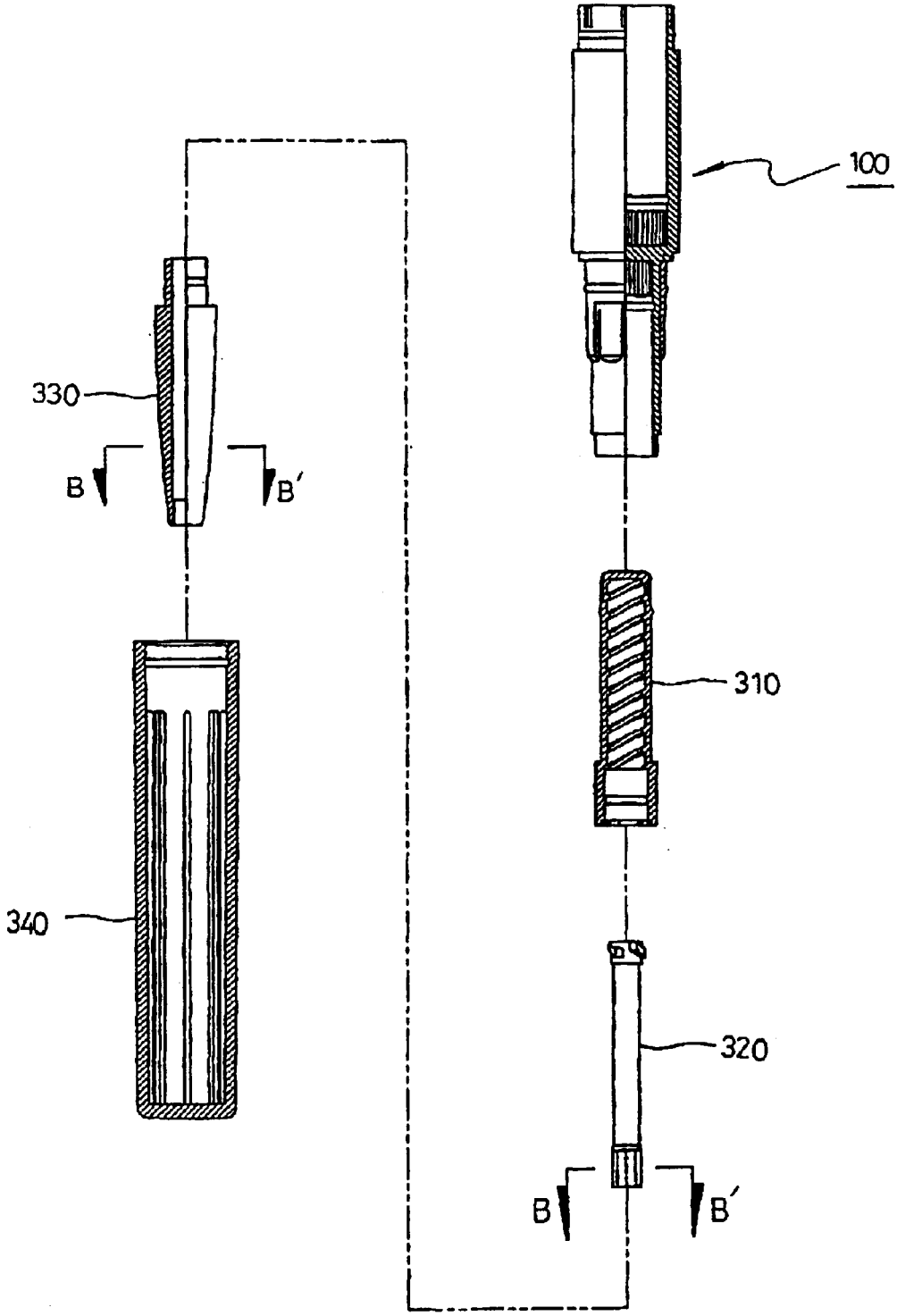
FIG. 4 illustrates a view of an assembly of a lip pencil part of the integrated lip pencil and lip pencil according to the present invention.

FIG. 4 illustrates a view of an assembly of the lip pencil part 300 of the integrated lip pencil and lip pencil according to the present invention. In FIG. 4, the lip pencil part 300 includes a lip pencil screw part 310 inserted into the lip pencil coupling part 120 of the coupling part 100, a lip pencil core supporter 320 inserted into the lip pencil screw part 310 and moving along a spiral line of the lip pencil screw part 310, a lip pencil cap 330 guiding a movement of the lip pencil core supporter 320 when the lip pencil core supporter 320 is moved, and a lip pencil outer cap 340 for covering the lip pencil cap 330.

The above components constituting the integrated lipstick and lip pencil according to the present invention will be describe in more detail as follows.

Figure 5A:
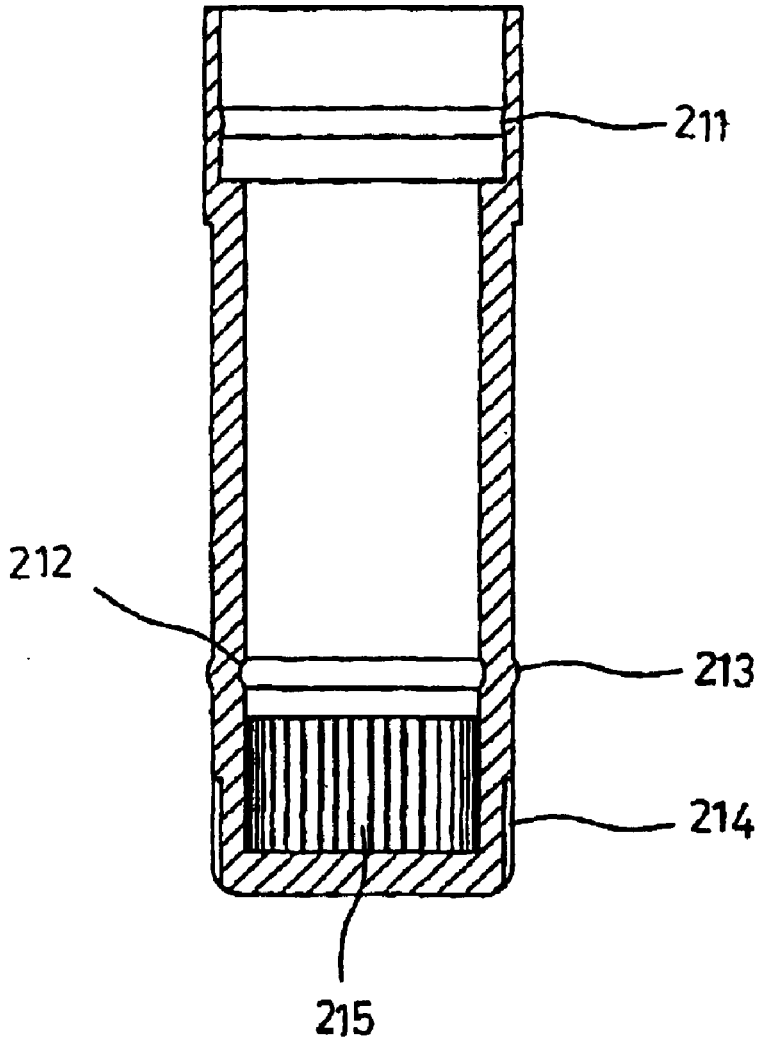
FIG. 5A illustrates a sectional view of a central body of the integrated lip pencil and lip pencil according to the present invention.

FIG. 5A illustrates a sectional view of the central body 210 of the integrated lip pencil and lip pencil according to the present invention.

The central body 210 has an empty inside, and includes a central body outer spline 214 and a central body outer jaw 213 formed on an outer circumference of an end of the central body 210 to be coupled with the lipstick coupling inner spline 114 and lipstick coupling inner jaw 113 of the coupling part 110 respectively, a central body inner spline 215 and a central body inner hole 212 formed inside the end of the central body 210 to be coupled with the lipstick screw part 220, and a central body inner support jaw 211 formed inside the other end of the central body 210.

Figure 5B:
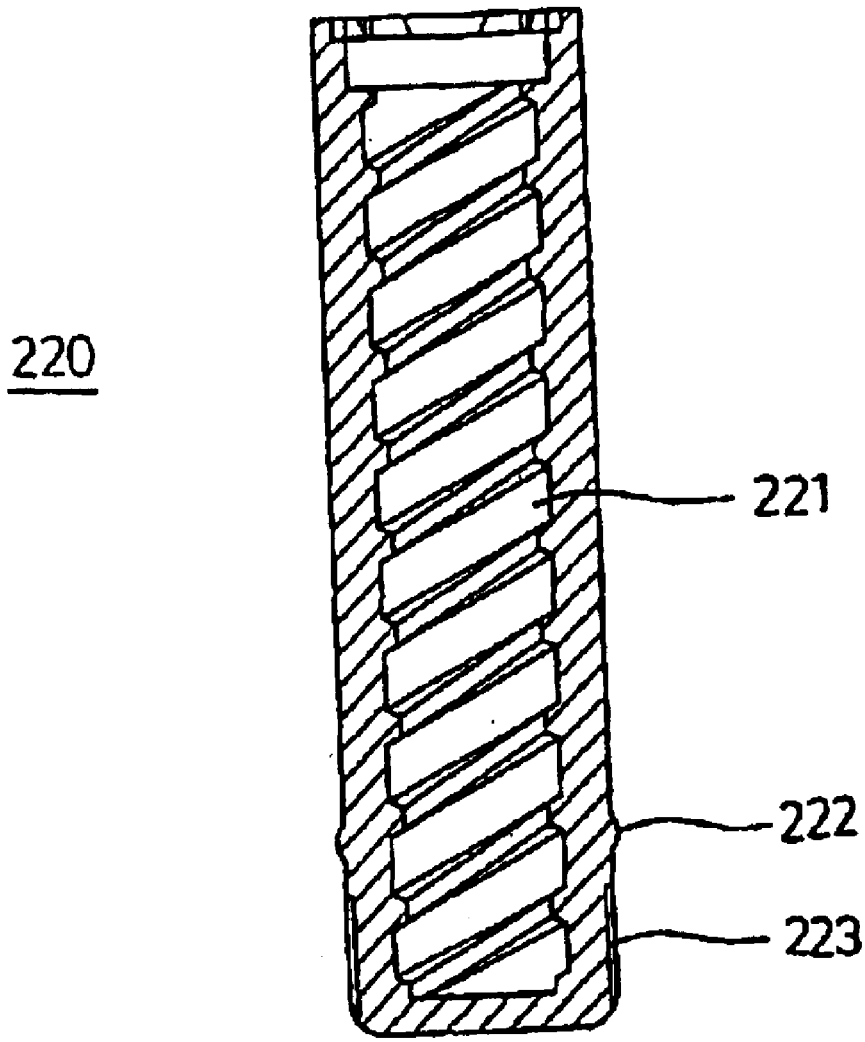
FIG. 5B illustrates a sectional view of a lipstick screw part of the integrated lip pencil and lip pencil according to the present invention.

FIG. 5B illustrates a sectional view of the lipstick screw part 220 of the integrated lip pencil and lip pencil according to the present invention.

The lipstick screw part 220 includes a screw part outer spline 223 and a screw part outer jaw 222 formed on the outside of the lipstick screw part 220 to be coupled with the central body inner spline 215 and the central body inner hole 212 respectively, and a screw spiral part 221 formed inside the lipstick screw part 220 to be coupled with the lipstick core supporter 230.

Figure 5C:
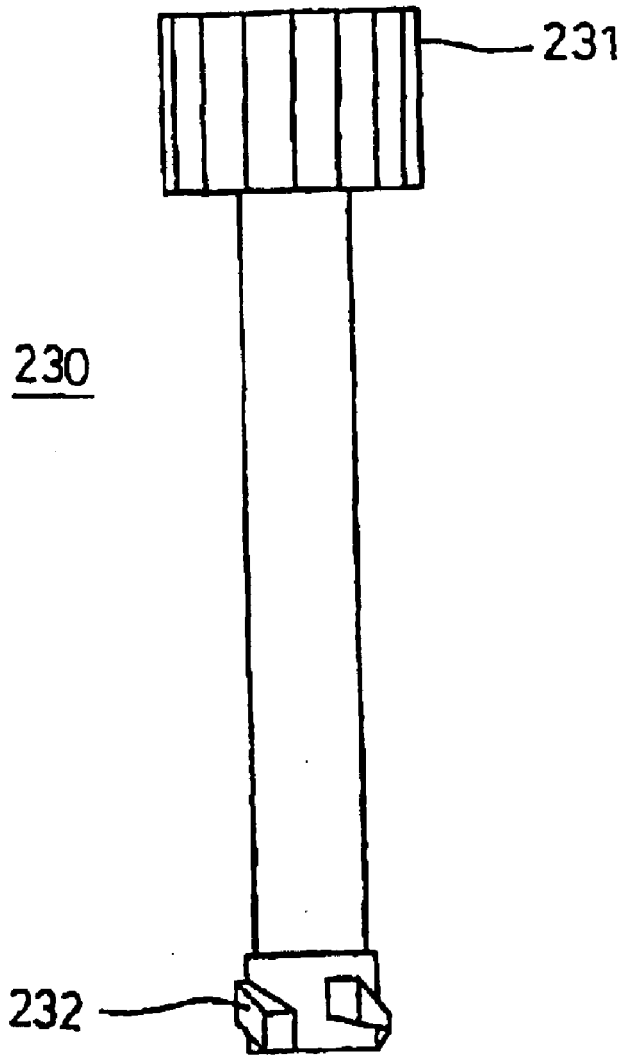
FIG. 5C illustrates a side view of a lipstick core supporter of the integrated lip pencil and lip pencil according to the present invention.

FIG. 5C illustrates a side view of the lipstick core supporter 230 of the integrated lip pencil and lip pencil according to the present invention.

The lipstick core supporter 230 includes a spiral insertion part 232 formed at an end of the lipstick core supporter 230 and inserted into the screw spiral part 221 of the lipstick screw part 220 to rotate and move along the screw spiral part 221, and a lipstick core insertion part 231 formed at the other end of the lipstick core supporter 230 to fix the lipstick core. Here, the lipstick core insertion part 231 has outer sides having, for example, twelve sides and edges.

Figure 5D:
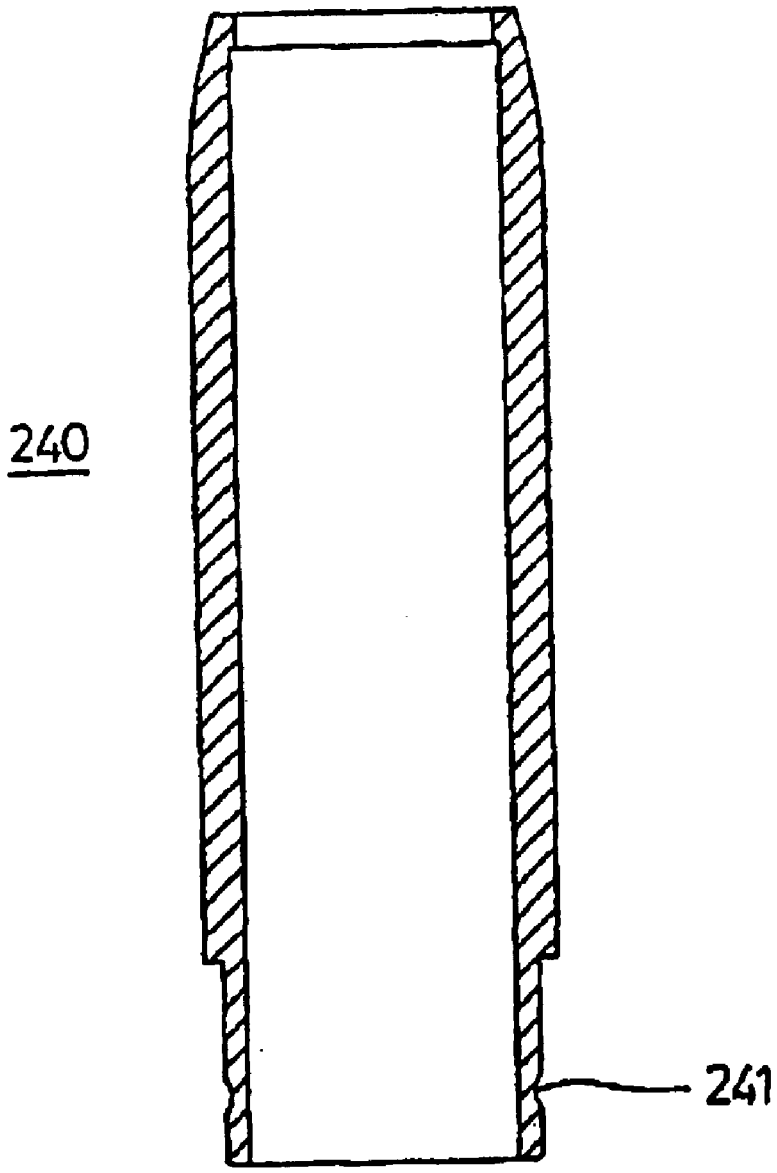
FIG. 5D illustrates a sectional view of a lipstick cap of the integrated lip pencil and lip pencil according to the present invention.

FIG. 5D illustrates a sectional view of the lipstick cap 240 of the integrated lip pencil and lip pencil according to the present invention. The lipstick cap 240 has inner sides having, for example, twelve sides and edges, corresponding to the outer sides of the core insertion part 231 of the core supporter 230. The outside of the lipstick cap 240 has a cylindrical portion at a part thereof and has an outer cap supporting hole 241 formed at the other part thereof to be coupled with the central body inner support jaw 211 of the central body 210. The outer cap supporting hole 241 is coupled with the central body inner support jaw 211, so that the lipstick cap 240 can rotate relative to the lipstick part 200. That is, the lipstick cap 240 can rotate relative to the central body 210, and be separated from the lipstick part 200 by a prescribed torsion force applied by the user.

Figure 5E:
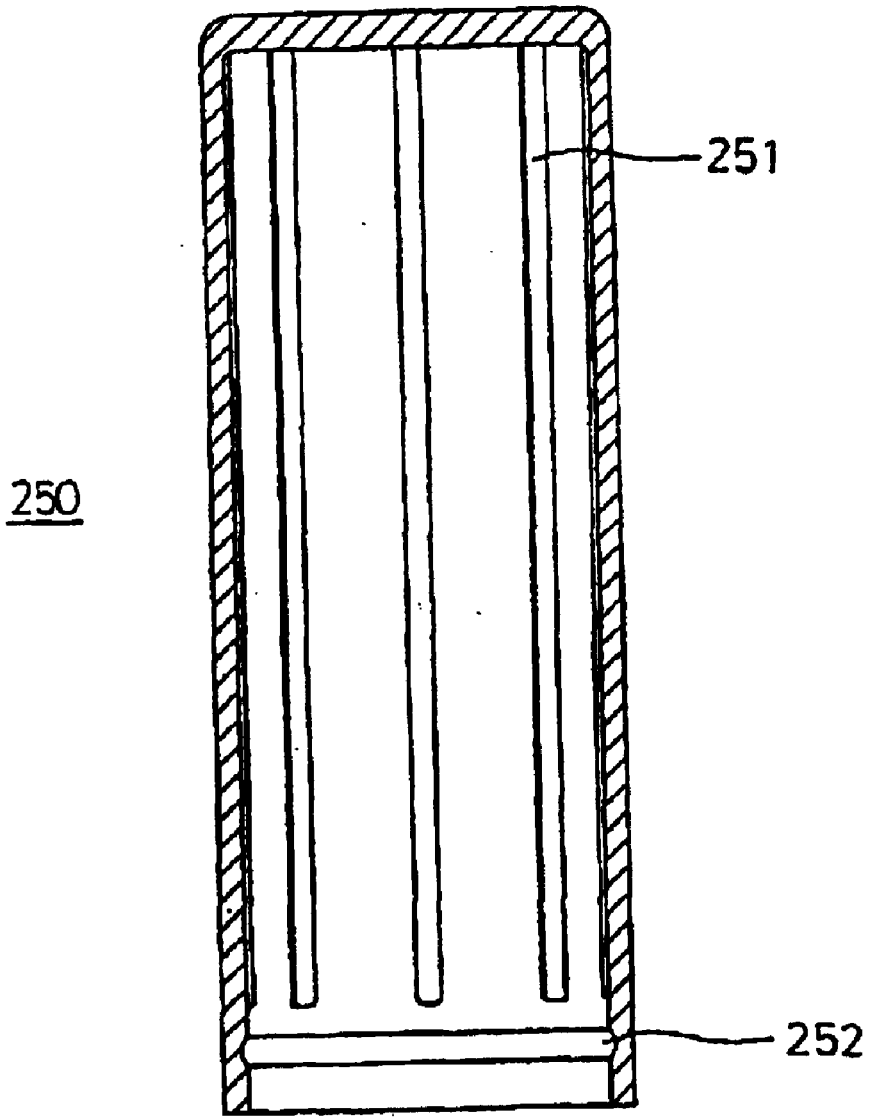
FIG. 5E illustrates a sectional view of a lipstick outer cap of the integrated lip pencil and lip pencil according to the present invention.

FIG. 5E illustrates a sectional view of the lipstick outer cap 250 of the integrated lip pencil and lip pencil according to the present invention.

As shown in FIG. 5E, the lipstick outer cap 250 is opened at a side, and includes a lipstick outer cap inner spline 251 formed on an inner circumference of the lipstick outer cap 250 to cover the lipstick part 200 coupled with the coupling part 100, and a lipstick outer cap inner hole 252 formed in the inner circumference of the lipstick outer cap 250 to be coupled with the outer jaw 112 of the coupling part 100.

Figure 6A:
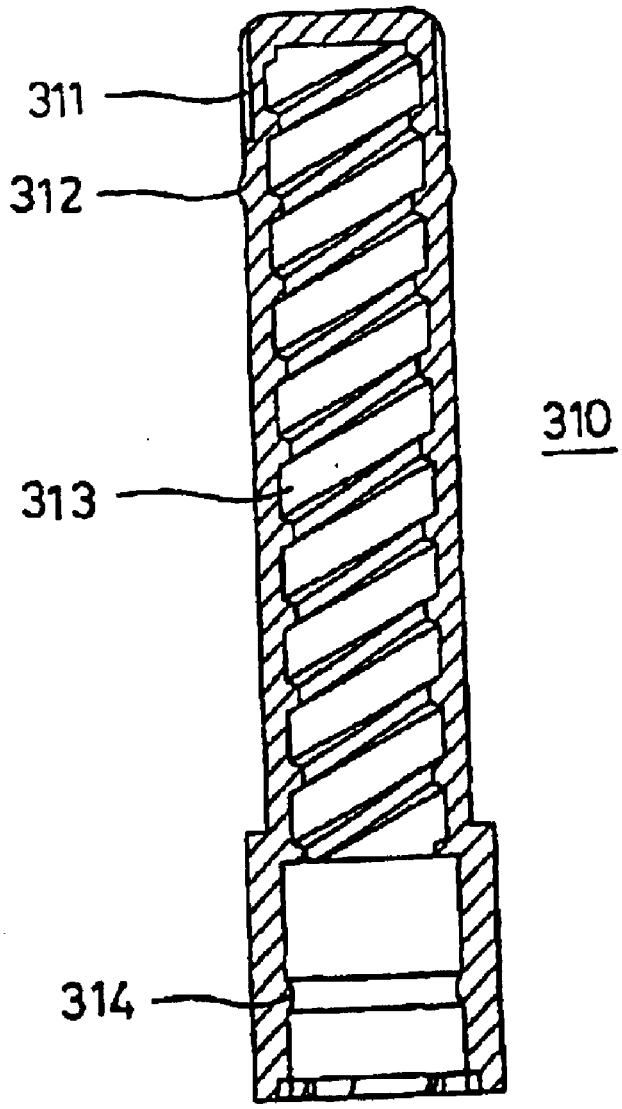
FIG. 6A illustrates a sectional view of a lip pencil screw of the integrated lip pencil and lip pencil according to the present invention.

FIG. 6A illustrates a sectional view of the lip pencil screw 310 of the integrated lip pencil and lip pencil according to the present invention.

As shown in FIG. 6A, the lip pencil screw 310 includes a screw part outer spline 311 and a screw part outer jaw 312 formed on an outer circumference thereof to be coupled with the lip pencil coupling inner spline 121 and the lip pencil coupling inner hole 122 of the lip pencil coupling part 120, and a screw spiral part 313 and a lip pencil-inner circumference rotating support jaw 314 formed on the inside of the lip pencil screw part 310.

Figure 6B:
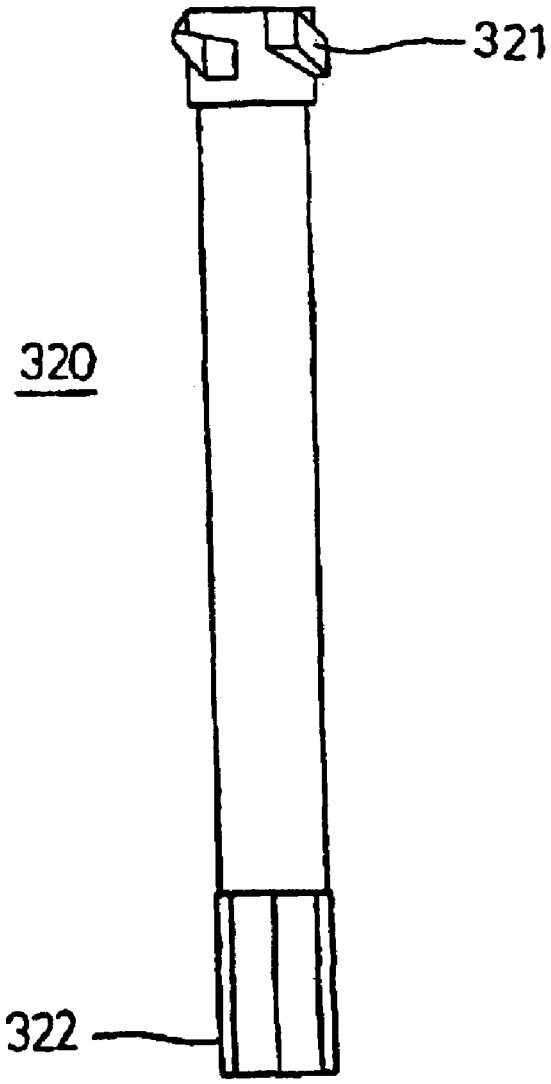
FIG. 6B illustrates a side view of a lip pencil core supporter of the integrated lip pencil and lip pencil according to the present invention.

FIG. 6B illustrates a side view of the lip pencil core supporter 320 of the integrated lip pencil and lip pencil according to the present invention.

As shown in FIG. 6B, the lip pencil core supporter 320 includes a spiral insertion part 321 formed at a side and inserted into the screw spiral part 313 of the screw part 310 to rotate and move along the screw spiral part 313, and a lip pencil core insertion part 322 formed at the other side to fix the pencil core. Here, the outside of the lip pencil core insertion part 332 has, for example, eight sides and edges.

Figure 6C:
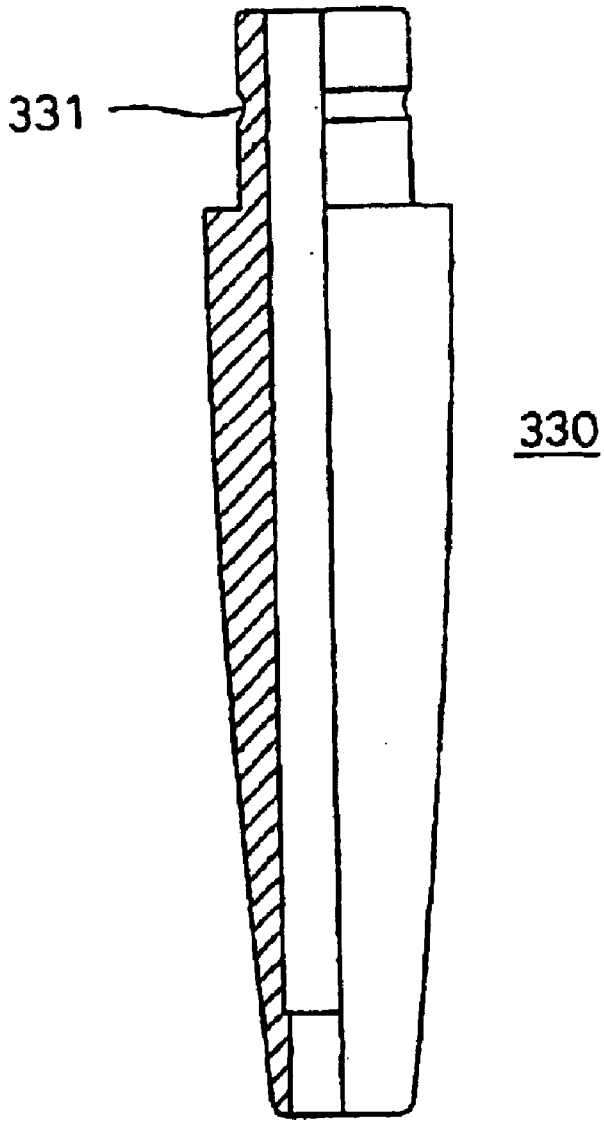
FIG. 6C illustrates a partial sectional view of a lip pencil cap of the integrated lip pencil and lip pencil according to the present invention.

FIG. 6C illustrates a partial sectional view of the lip pencil cap 330 of the integrated lip pencil and lip pencil according to the present invention.

As shown in FIG. 6C, the inside of the lip pencil cap 330 has, for example, eight sides and edges corresponding to the outer sides of the lip pencil core insertion part 332. The outside of the lip pencil cap 330 has a cylindrical portion at a part and has an outer cap hole 331 formed at the other part thereof to be coupled with the lip pencil inner circumference rotating jaw 314 of the screw part 310. The outer cap hole 331 is coupled with the lip pencil inner circumference rotating jaw 314, so that the lip pencil cap 330 can rotate relative to the lip pencil part 200. That is, the lip pencil cap 240 can rotate relative to the screw part 310, and be separated from the lip pencil part 300 by a prescribed torsion force applied by the user.

Figure 6D:
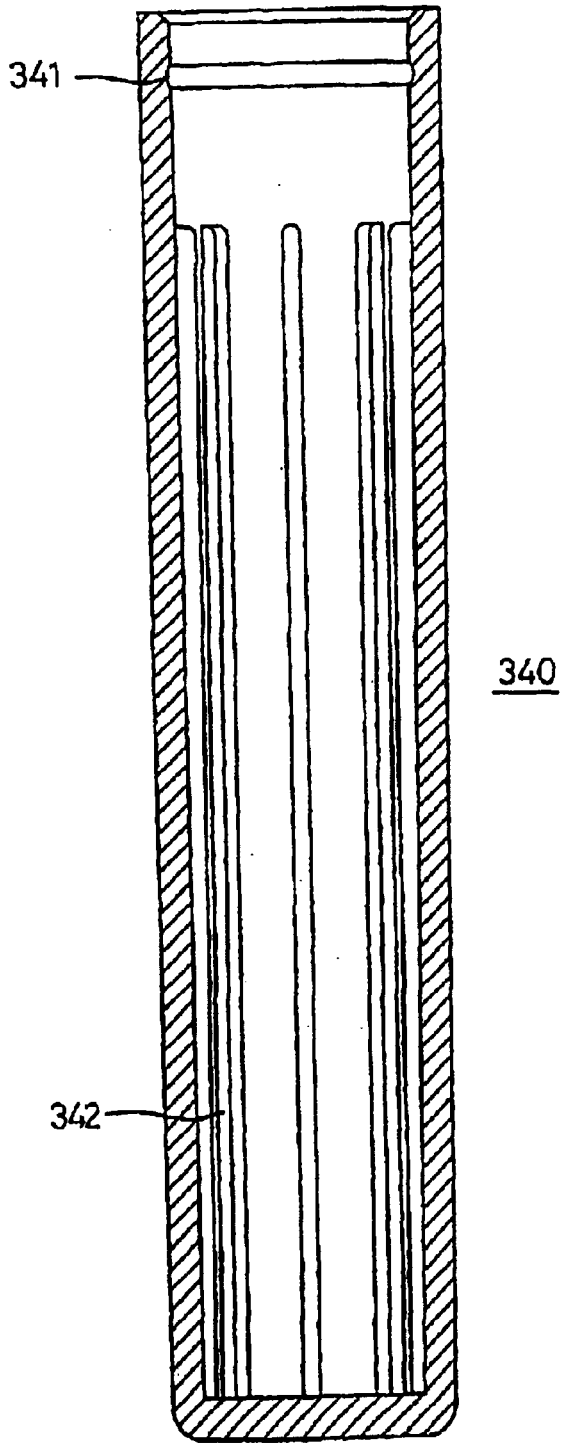
FIG. 6D illustrates a sectional view of a lip pencil outer cap of the integrated lip pencil and lip pencil according to the present invention.

FIG. 6D illustrates a sectional view of the lip pencil outer cap 340 of the integrated lip pencil and lip pencil according to the present invention.

As shown in FIG. 6D, the lip pencil outer cap 340 is opened at a side, and includes a lip pencil outer cap inner spline 342 and a lip pencil outer cap inner hole 341 formed in an inner circumference thereof to be coupled with the outer spline 124 and the outer jaw 123 of the coupling part 100 respectively.

The operation of the integrated lip pencil and lip pencil according to the present invention will be described as follows.

1) Operation as the Lipstick

To paint the user's lips with the lipstick having a prescribed color, first, the lipstick outer cap 250 is separated from the integrated lip pencil and lip pencil and the lipstick cap 240 is exposed. After that, the user holds the coupling part 100 and/or the lip pencil part 300 with one hand and rotates the lipstick cap 240 in a prescribed direction with the other hand. Then, the lipstick cap 240 is rotated relative to the coupling part 100 because being coupled with the central body 210 to be rotated with the central body 210. When the lipstick cap 240 is rotated, the lipstick core supporter 230, which is slidingly movable, is also rotated. Then, the spiral insertion part 232 of the lipstick core supporter 230 is also rotated along the screw spiral part 221 of the screw part 220 mounted inside the coupling part 100. When the lipstick core supporter 230 is moved along the screw spiral part 221, the lipstick adhered at an end portion of the lipstick core supporter 230 is exposed from an end of the lipstick cap 240 to the outside.

Therefore, the user can paint the user's lips using the lipstick exposed to the outside.

Meanwhile, to let lipstick in the inside or carry, the user operates the integrated lip pencil and lip pencil to the contrary.

2) Operation as the Lip Pencil

To pencil the user's lip line clear after painting the lips with the integrated lip pencil and lip pencil, the lip pencil, which is mounted in an opposite direction of the lipstick part, is used. The lip pencil outer cap 340 is separated from the integrated lip pencil and lip pencil and exposed to the outside. After that, the user holds the coupling part 100 and/or the lipstick part 200 with one hand, and rotates the lip pencil cap 330 in a prescribed direction with the other hand. Then, the lip pencil cap 330 is rotated relative to the coupling art 100 because being coupled with the screw part 310 to be rotated with the screw part 310. The lip pencil core supporter 320, which is slidingly movable, is also rotated when the lip pencil cap 330 is rotated.

The spiral insertion part 321 of the lip pencil core supporter 320 is also rotated along the screw spiral part 313 of the screw part 310. When the lip pencil core supporter 320 is moved along the screw spiral part 313, the pencil adhered on an end of the lip pencil core supporter is exposed to the outside from an end of the lip pencil cap 33.

Therefore, the user can pencil the lip line clear using the lip pencil exposed.

Meanwhile, to let lip pencil in the inside or carry, the user operates the integrated lip pencil and lip pencil to the contrary.

Here, because the components constituting the coupling part, the lipstick part and the lip pencil part are assembled by the splines, the coupling holes and the coupling jaws respectively, they are not easily separated by a small shock, and are affected by a large power in a rotational direction.

INDUSTRIAL APPLICABILITY

As described above, because the integrated lipstick and lip pencil according to the present invention takes a form in which the lipstick and the lip pencil is combined in one body, the user can conveniently and rapidly paint the lips and it is convenient to keep and carry it.

Furthermore, the integrated lipstick and lip pencil according to the present invention can reduce the number of cosmetics and save money for buying cosmetics.

Moreover, in the integrated lipstick and lip pencil according to the present invention, the components constituting the lipstick part, the lip pencil part and the coupling part coupling the lipstick part and the lip pencil part are assembled by the splines, the coupling holes and the coupling jaws respectively, they are not easily separated or lost when being used or carried, and the user can use it until the contents of the lipstick and lip pencil are completely consumed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An integrated lipstick and lip pencil comprising:

a lipstick part for painting a user's lips with a lipstick of a prescribed color, said lipstick part including an inner spline and an inner hole;

a lip pencil part for penciling a lip line using a lip pencil;

a coupling part for coupling the lipstick part and the lip pencil part to combine them into one body, said coupling part including a cylindrically hollow lipstick coupling part formed at a side to be coupled with the lipstick part, and a cylindrically hollow lip pencil part formed at the other side to be coupled with the lip pencil part, said inner spline formed on an inner wall of said coupling part to be coupled with said lipstick part, said inner hole being formed in the inner wall of said coupling part to be coupled with said lipstick part and operate with said inner spline;

a central body inserted into the lipstick coupling part and coupled with the inner spline and the inner hole;

a lipstick screw part inserted and coupled into the central body;

a lipstick core supporter, in which a lipstick core is fixed, moving along the lipstick screw part; and a lipstick cap for guiding the movement of the lipstick core supporter when the lipstick core supporter is moved, the lipstick cap protecting the lipstick core.

2. The integrated lipstick and lip pencil according to claim 1, wherein the lipstick coupling part further includes an outer jaw formed on an outer circumference of the lipstick coupling part.

3. The integrated lipstick and lip pencil according to claim 2, wherein the lipstick part further includes a lipstick outer cap coupled with the outer jaw of the lipstick coupling part, the lipstick outer cap covering the lipstick part.

4. The integrated lipstick and lip pencil according to claim 1, wherein the lip pencil coupling part includes:

an inner spline formed on an inner wall of the lip pencil coupling part to be coupled with the lip pencil part; and an inner hole formed in an inner wall of the lip pencil coupling part to be coupled with the lip pencil part and operate with the inner spline.

5. The integrated lipstick and lip pencil according to claim 4, wherein the lip pencil part includes:

a lip pencil screw part inserted into the lip pencil coupling part of the coupling part;

a lip pencil core supporter inserted into the lip pencil screw part, the lip pencil core supporter moving along a spiral line of the lip pencil screw part; and a lip pencil cap for guiding the movement of the lip pencil core supporter when the lip pencil core supporter is moved.

6. The integrated lipstick and lip pencil according to claim 5, wherein the lip pencil coupling part further includes an outer spline and an outer jaw formed on an outer circumference thereof respectively.

7. The integrated lipstick and lip pencil according to claim 6, wherein the lip pencil part further includes a lip pencil outer cap coupled with the outer spline and the outer jaw, the lip pencil outer cap covering the lip pencil part.

8. The integrated lipstick and lip pencil according to claim 7, wherein the lip pencil outer cap includes an inner spline and an inner hole formed in an inner circumference of the lip pencil outer cap to be coupled with the outer spline and the outer jaw respectively.

9. The integrated lipstick and lip pencil according to claim 4, wherein the lip stick coupling part includes:

an inner spline formed on an inner wall to be coupled with the lipstick part; and an inner hole formed in the inner wall to be coupled with the lipstick part and operate with the inner spline.

10. The integrated lipstick and lip pencil according to claim 9, wherein the lipstick part includes:

a central body inserted into the lipstick coupling part and coupled with the inner spline and inner hole;

a lipstick screw part inserted and coupled in to the central body;

a lipstick core supporter, in which a lipstick core is fixed, moving along the lipstick screw part; and a lipstick cap for guiding the movement of the lipstick core supporter when the lipstick core supporter is moved, the lipstick cap protecting the lipstick core.

11. The integrated lipstick and lip pencil according to claim 9, wherein the lipstick coupling part further includes an outer spline and an outer jaw formed on an outer circumference thereof.

12. The integrated lipstick and lip pencil according to claim 11, wherein the lipstick part further includes a lipstick outer cap coupled with the outer spline and the outer jaw of the lipstick coupling part, the lipstick outer cap covering the lipstick part.

13. The integrated lipstick and lip pencil according to claim 12, wherein the lipstick outer cap includes an inner spline and an inner hole formed in an inner circumference thereof to be coupled with the outer spline and the outer jaw of the coupling part.

* * * * *